US011987954B2

(12) United States Patent
Yamamoto

(10) Patent No.: US 11,987,954 B2
(45) **Date of Patent: *May 21, 2024**

(54) SHOVEL

(71) Applicant: SUMITOMO(S.H.I.) CONSTRUCTION MACHINERY CO., LTD., Tokyo (JP)

(72) Inventor: Takashi Yamamoto, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/045,874

(22) Filed: Oct. 12, 2022

(65) Prior Publication Data

US 2023/0054977 A1 Feb. 23, 2023

Related U.S. Application Data

(63) Continuation of application No. 16/536,783, filed on Aug. 9, 2019, now Pat. No. 11,479,945, which is a (Continued)

(30) Foreign Application Priority Data

Feb. 22, 2017 (JP) ..... 2017-030792

(51) Int. Cl.
*E02F 9/20* (2006.01)
*E02F 9/24* (2006.01)

(52) U.S. Cl.
CPC ..... *E02F 9/2004* (2013.01); *E02F 9/24* (2013.01)

(58) Field of Classification Search
CPC . E02F 9/2004; E02F 9/24; E02F 9/226; E02F 9/2296; E02F 9/262; E02F 9/123; (Continued)

(56) References Cited

U.S. PATENT DOCUMENTS 5,198,800 A * 3/1993 Tozawa ..... E02F 9/2033 340/685
5,711,391 A * 1/1998 Brandt ..... E02F 9/2275 180/273

(Continued)

FOREIGN PATENT DOCUMENTS

JP H08-302748 11/1996
JP H08-333767 12/1996

(Continued)

OTHER PUBLICATIONS

International Search Report for PCT/JP2018/006498 dated May 15, 2018.

*Primary Examiner* — Paul N Dickson
*Assistant Examiner* — Timothy Wilhelm
(74) *Attorney, Agent, or Firm* — IPUSA, PLLC

(57) ABSTRACT

A shovel includes a lower traveling body, an upper traveling body turnably mounted on the lower traveling body, a hydraulic actuator, an operating apparatus configured to be operated to operate the hydraulic actuator, an object detector configured to detect an object within a predetermined area around the shovel, a gate lock lever configured to switch the operating apparatus between an enabled state and a disabled state, and a control device. The control device is configured to switch the operating apparatus between the enabled state and the disabled state separately from the gate lock lever, and to disable the operating apparatus in response to determining that the object is present within the predetermined area based on the output of the object detector while the operating apparatus is switched to the enabled state by the gate lock lever, during the standby state of the shovel.

7 Claims, 10 Drawing Sheets

Related U.S. Application Data continuation of application No. PCT/JP2018/006498, filed on Feb. 22, 2018.

(58) Field of Classification Search

CPC ..... F15B 2211/6355; F15B 2211/67; F15B 2211/8603; F15B 2211/8752

See application file for complete search history.

(56) References Cited

U.S. PATENT DOCUMENTS 6,186,260 B1 * 2/2001 Schenck ..... B60K 25/00 180/273
6,226,902 B1 * 5/2001 Heyne ..... E02F 9/2004 37/348
6,577,909 B1 * 6/2003 McGowan ..... G05B 9/02 700/79
7,283,903 B2 * 10/2007 Merten ..... E02F 9/166 307/10.6
7,342,486 B2 * 3/2008 Tsukada ..... E02F 9/26 348/148
7,743,865 B2 * 6/2010 Brunner ..... G05D 1/0238 180/271
7,899,597 B2 * 3/2011 Vitale ..... E02F 9/2095 701/50
8,016,074 B2 * 9/2011 Black ..... B66F 11/044 182/2.1
8,248,263 B2 * 8/2012 Shervey ..... G07C 9/28 340/8.1
8,346,512 B2 * 1/2013 McAree ..... E02F 9/2033 701/1
8,437,920 B2 * 5/2013 Hobenshield ..... E02F 9/26 701/50
8,700,246 B2 * 4/2014 Kurikuma ..... E02F 9/2246 701/50
8,768,583 B2 * 7/2014 Hargrave, Jr. ..... E02F 9/262 340/436
8,773,286 B1 * 7/2014 Friend ..... A23L 33/105 340/435
8,810,210 B2 * 8/2014 Yokoyama ..... B60L 50/40 320/166
8,880,302 B1 * 11/2014 Tachibana ..... E02F 9/125 60/459
8,917,292 B2 * 12/2014 Gotou ..... E02F 9/267 348/148
9,030,332 B2 * 5/2015 Tafazoli Bilandi ..... E02F 9/262 348/222.1
9,080,311 B2 * 7/2015 Yoshida ..... E02F 9/2285
9,133,602 B2 * 9/2015 Ooki ..... E02F 9/2095
9,133,604 B2 * 9/2015 Kodaka ..... B60T 13/66
9,206,588 B2 * 12/2015 Wu ..... B60L 50/15
9,457,718 B2 * 10/2016 Husted ..... E02F 9/24
9,587,380 B2 * 3/2017 Matsumoto ..... H04N 7/183
9,598,036 B2 * 3/2017 Lim ..... B66C 15/06
9,695,024 B2 * 7/2017 Herauf ..... E01D 19/106
9,695,982 B2 * 7/2017 Rivet ..... F16P 3/147
9,715,015 B2 * 7/2017 Izumikawa ..... G06V 20/56
9,776,566 B2 * 10/2017 Ishimoto ..... E02F 9/262
9,836,938 B2 * 12/2017 Kiyota ..... E02F 9/24
9,911,320 B2 * 3/2018 Franz ..... G08C 23/04
9,975,522 B2 * 5/2018 Nakamura ..... E02F 9/2062
9,990,543 B2 * 6/2018 Fukuda ..... B60R 11/04
10,100,497 B2 * 10/2018 Izumikawa ..... E02F 3/435
10,323,386 B2 * 6/2019 Kiyota ..... G08B 13/19602
10,380,473 B2 * 8/2019 Manci ..... G07C 5/008
10,544,567 B2 * 1/2020 Petrany ..... E02F 9/205
10,697,152 B2 * 6/2020 Izumikawa ..... E02F 9/26
10,794,046 B2 * 10/2020 Imura ..... E02F 9/26
10,915,308 B2 * 2/2021 Mori ..... B60R 16/02
10,927,528 B2 * 2/2021 Morimoto ..... E02F 9/2004
11,015,319 B2 * 5/2021 Izumikawa ..... E02F 9/2041
11,292,700 B2 * 4/2022 Lyngbäck ..... B66C 13/46
11,320,830 B2 * 5/2022 Moorehead ..... E02F 9/262
11,365,527 B2 * 6/2022 Kiyota ..... B60R 1/00
11,501,619 B2 * 11/2022 Cherney ..... G08B 21/02
2007/0203630 A1 8/2007 Vitale et al.
2010/0036645 A1 * 2/2010 McAree ..... B60T 7/22 703/1
2012/0327261 A1 * 12/2012 Tafazoli Bilandi ..... E02F 9/24 348/E5.022
2013/0088593 A1 * 4/2013 Ishimoto ..... E02F 9/261 348/143
2013/0264138 A1 10/2013 Phillips
2014/0354813 A1 * 12/2014 Ishimoto ..... E02F 9/24 348/148
2015/0112544 A1 4/2015 Tsukamoto
2015/0114731 A1 4/2015 Tsukamoto
2015/0175071 A1 * 6/2015 Ishimoto ..... H04N 7/18 348/148
2015/0240454 A1 * 8/2015 Yogita ..... E02F 9/2066 60/277
2016/0200252 A1 * 7/2016 Oota ..... E02F 9/2033 348/148
2017/0021769 A1 1/2017 Izumikawa et al.
2017/0028919 A1 * 2/2017 Izumikawa ..... H04N 7/18
2017/0058489 A1 3/2017 Nomura et al.
2017/0073935 A1 * 3/2017 Friend ..... E02F 9/265
2017/0107692 A1 * 4/2017 Robertson ..... E02F 3/48
2018/0122218 A1 * 5/2018 Shanley ..... E02F 9/262
2018/0258616 A1 * 9/2018 Kiyota ..... E02F 9/267
2022/0397897 A1 * 12/2022 Pandita ..... G06V 20/59

FOREIGN PATENT DOCUMENTS

JP H09-242110 9/1997
JP H10-195915 7/1998
JP H11-021079 1/1999
JP H11-181821 7/1999
JP 2000-104291 4/2000
JP 2000-309947 11/2000
JP 2002-13425 1/2002
JP 2002-285587 10/2002
JP 2002-371593 12/2002
JP 2009-527672 7/2009
JP 2009-215855 9/2009
JP 2012-17626 1/2012
JP 2012-21362 2/2012
JP 2012-219461 11/2012
JP 2014-009555 1/2014
JP 2014-173258 9/2014
JP 2014-181509 9/2014
JP 2014173258 A * 9/2014
JP 2015-139161 7/2015
WO 2013/179517 12/2013
WO 2014/013910 1/2014
WO 2014/013911 1/2014
WO 2014/148202 9/2014

* cited by examiner

SHOVEL

CROSS-REFERENCE TO RELATED APPLICATIONS

The present application is a continuation of U.S. patent application Ser. No. 16/536,783, filed on Aug. 9, 2019, which is a continuation application filed under 35 U.S.C. 111(a) claiming benefit under 35 U.S.C. 120 and 365(c) of PCT International Application No. PCT/JP2018/006498, filed on Feb. 22, 2018 and designating the U.S., which claims priority to Japanese patent application No. 2017-030792, filed on Feb. 22, 2017. The entire contents of the foregoing applications are incorporated herein by reference.

BACKGROUND

Technical Field

The present invention relates to shovels.

Description of Related Art

A shovel with a gate lock lever that switches a hydraulic locked state and a hydraulic unlocked state is known. In the hydraulic unlocked state, in response to an operator's operation of an operating lever, a corresponding hydraulic actuator operates. That is, the operating apparatus is enabled. In the hydraulic locked state, even when the operator operates the operating lever, the corresponding hydraulic actuator does not operate. That is, the operating apparatus is disabled.

SUMMARY

According to an aspect of the present invention, a shovel includes a lower traveling body, an upper traveling body turnably mounted on the lower traveling body, a hydraulic actuator, an operating apparatus configured to be operated to operate the hydraulic actuator, an object detector configured to detect an object within a predetermined area around the shovel, a gate lock lever configured to switch the operating apparatus between an enabled state and a disabled state, and a control device. The control device is configured to switch the operating apparatus between the enabled state and the disabled state separately from the gate lock lever, and to disable the operating apparatus in response to determining that the object is present within the predetermined area based on the output of the object detector while the operating apparatus is switched to the enabled state by the gate lock lever, during the standby state of the shovel.

DETAILED DESCRIPTION

According to the above-described shovel with a gate lock lever that switches a hydraulic locked state and a hydraulic unlocked state, the operator creates the hydraulic unlocked state (the state where the operating apparatus is enabled) using the gate lock lever when operating the shovel, and creates the hydraulic locked state (the state where the operating apparatus is disabled) using the gate lock lever when suspending the operation of the shovel. The operator, however, may forget to lock the gate lock lever, for example, when suspending the operation of the shovel to have a conversation, respond to a phone call, or open the front window for checking arrangements with a site worker outside the shovel. In this case, the operator may accidentally touch the operating lever.

In view of the foregoing, it is desirable to provide a shovel that can prevent a hydraulic actuator from moving regardless of an operator's intention because of an inadvertent or inappropriate movement of an operating apparatus during suspension of the operation of the shovel with the operating apparatus being still enabled.

According to an aspect of the present invention, a shovel that can prevent a hydraulic actuator from moving regardless of an operator's intention because of an inadvertent or inappropriate movement of an operating apparatus during suspension of the operation of the shovel with the operating apparatus being still enabled is provided.

Figure 1A:
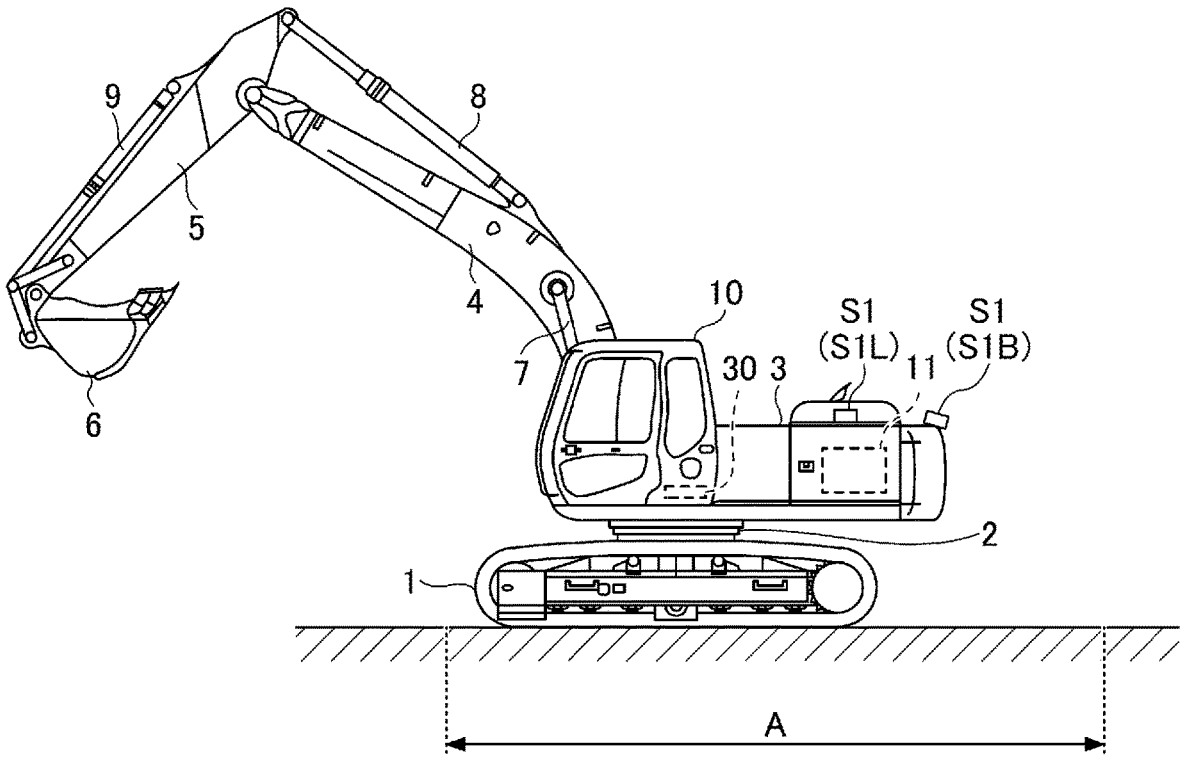
FIG. 1A is a side view of a shovel according to an embodiment of the present invention.
Figure 1B:
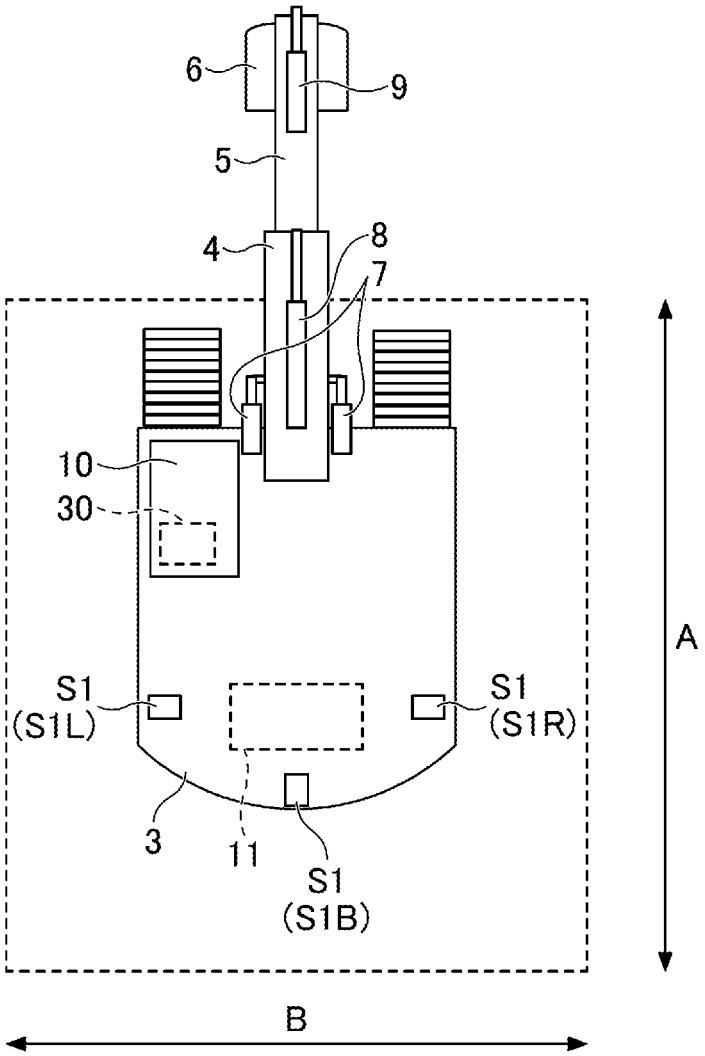
FIG. 1B is a plan view of the shovel according to the embodiment of the present invention.

First, with reference to FIGS. 1A and 1B, a shovel (excavator) as a construction machine according to an embodiment of the present invention is described. FIG. 1A is a side view of the shovel, and FIG. 1B is a plan view of the shovel. On a lower traveling body 1 of the shovel illustrated in FIGS. 1A and 1B, an upper turning body 3 is turnably mounted through a turning mechanism 2. A boom 4 serving as a work element is attached to the upper turning body 3. An arm 5 serving as a work element is attached to the end of the boom 4, and a bucket 6 serving as a work element and an end attachment is attached to the end of the arm 5. The boom 4, the arm 5, and the bucket 6 are hydraulically driven by a boom cylinder 7, an arm cylinder 8, and a bucket cylinder 9, respectively. A cabin 10 is provided and power sources such as an engine 11 are mounted on the upper turning body 3. Furthermore, a controller 30, a camera S1, etc., are attached to the upper turning body 3.

The controller 30 is a control device for controlling the shovel. According to this embodiment, the controller 30 is composed of a computer including a CPU, a RAM, an NVRAM, a ROM, etc. The controller 30 reads programs corresponding to various functional elements from the ROM, loads the programs into the RAM, and causes the CPU to execute corresponding processes.

The camera S1 captures images of the surroundings of the shovel. According to this embodiment, the camera S1 includes a back camera S1B attached to the back end of the upper surface of the upper turning body 3, a left camera S1L attached to the left end of the upper surface of the upper turning body 3, and a right camera S1R attached to the right end of the upper surface of the upper turning body 3. The camera S1 operates as an object detector configured to detect or monitor an object within a predetermined area around the shovel. In this case, the camera S1 may include an image processor. By performing various kinds of image processing on an image captured by the camera S1 (input image), the image processor detects an object image included in the input image. When detecting an object image, the camera S1 outputs an object detection signal to the controller 30. Objects include persons, animals, vehicles, and machines. Objects may include persons, animals, vehicles, machines, buildings, and signs. Furthermore, objects may include persons, animals, vehicles, and machines as entering objects and include buildings and signs as features. Here, the image processor may determine that an object that has entered the predetermined area around the shovel is an entering object and determine that an object outside the predetermined area is not an entering object. At this point, the object detector may detect persons, animals, machines, buildings, signs, etc., as objects. The object detector may also be configured to detect persons, animals, vehicles, machines, etc., that are entering objects and not to detect buildings, signs, etc., that are features. The image processor may be configured to detect a moving body. Furthermore, the image processor may be integrated into the controller 30. The object detector may be an ultrasonic sensor, a millimeter wave sensor, a laser radar sensor, an infrared sensor or the like. According to this embodiment, when an entering object is present within predetermined bounds at a predetermined distance from the shovel, the image processor detects the presence of the entering object by pattern recognition or the like. Alternatively, instead of using pattern recognition, the entering object may be detected on the shovel side using the output of a communications device attached to the entering object. Furthermore, when current land features are known, the image processor can prevent upright land features such as a cliff from being erroneously detected as entering objects by excluding the current land features from detection targets.

The area indicated by the dashed line in FIG. 1B represents an example of the predetermined area around the shovel. Specifically, the predetermined area has a longitudinal dimension A extending in a longitudinal axial direction of the shovel and a transverse dimension B extending in a transverse axial direction of the shovel. The longitudinal dimension A is, for example, the length of the lower traveling body 1 plus 1 meter from the front and 4 meters from the back of the lower traveling body 1. The transverse dimension B is, for example, the width of the lower traveling body 1 plus 3 meters from the left and 3 meters from the right of the lower traveling body 1. The shape of the predetermined area in a plan view may also be a shape other than a rectangle, such as a circle or an ellipse.

The shovel may include an object detector that monitors an area over the upper turning body 3, in order to detect a worker who works on top of the upper turning body 3, etc. Furthermore, the shovel may include an object detector that monitors an area below the lower traveling body 1, in order to detect a worker who goes and works underneath the lower traveling body 1.

Figure 2:
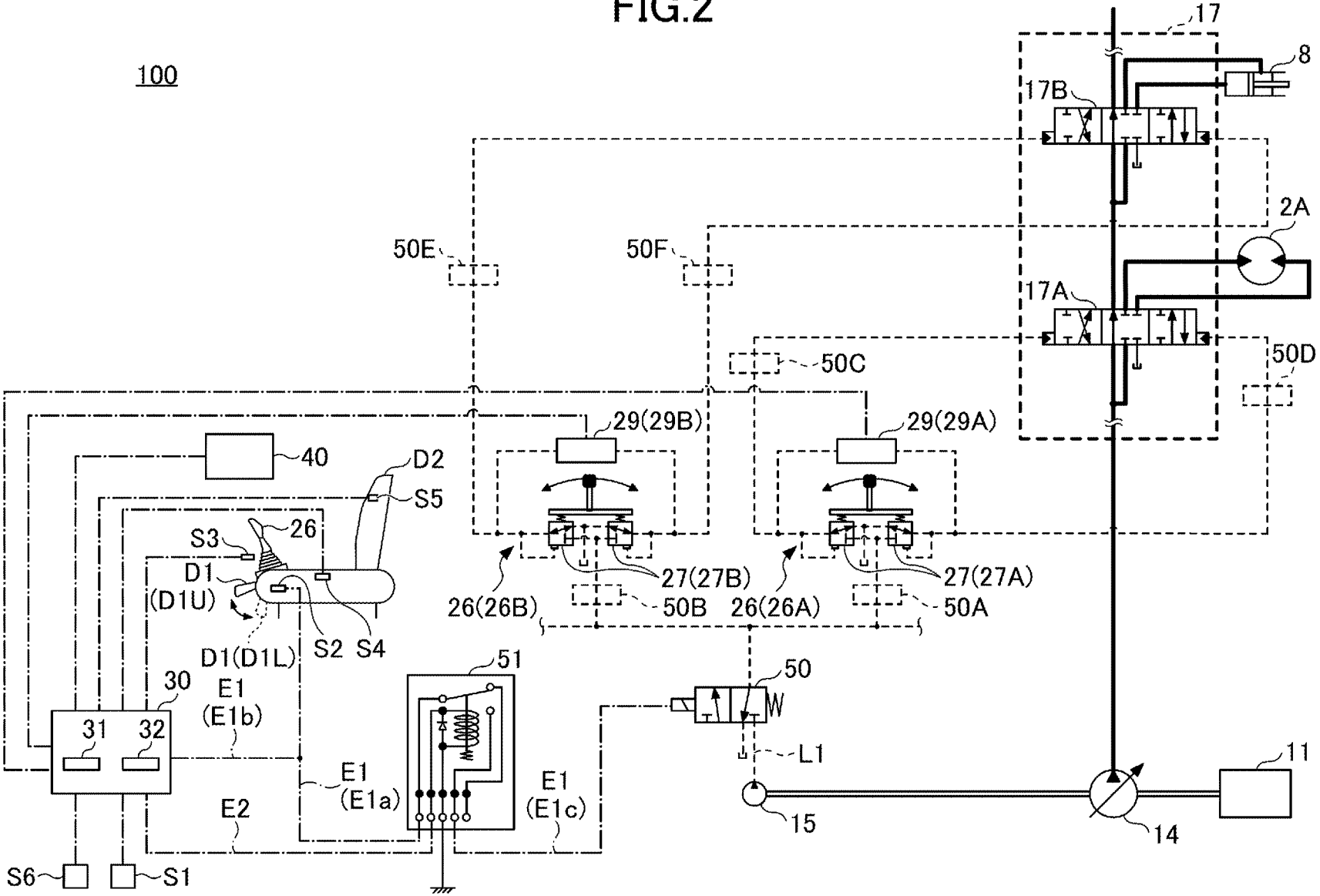
FIG. 2 is a schematic diagram illustrating a configuration of a control system installed in the shovel according to the embodiment of the present invention.

Next, a control system 100 installed in the shovel according to this embodiment is described with reference to FIG. 2. FIG. 2 is a schematic diagram illustrating a configuration of the control system 100, in which a mechanical power transmission line, a hydraulic oil line, a pilot line, and an electrical control line are indicated by a double line, a thick solid line, a dashed line, and a dotted line, respectively.

The control system 100 basically includes the engine 11, a main pump 14, a pilot pump 15, a control valve 17, an operating apparatus 26, a remote control valve 27, an operating pressure sensor 29, the controller 30, a gate lock valve 50, a gate lock relay 51, and a gate lock lever D1.

The engine 11 is a drive source of the shovel. According to this embodiment, the engine 11 is, for example, a diesel engine serving as an internal combustion engine that operates to maintain a predetermined rotational speed. The output shaft of the engine 11 is coupled to the respective input shafts of the main pump 14 and the pilot pump 15.

The main pump 14 is an apparatus for supplying hydraulic oil to the control valve 17 via a hydraulic oil line, and is, for example, a swash plate variable displacement hydraulic pump.

The pilot pump 15 is an apparatus that supplies hydraulic oil to various hydraulic control apparatuses including the operating apparatus 26 through a pilot line, and is, for example, a fixed displacement hydraulic pump.

The control valve 17 is a hydraulic control device that controls a hydraulic system in the shovel. Specifically, the control valve 17 includes control valves that control the flow of hydraulic oil discharged by the main pump 14. The control valve 17 can selectively supply the hydraulic oil discharged by the main pump 14 to one or more hydraulic actuators through the control valves. The control valves can control the flow rate of hydraulic oil flowing from the main pump 14 to the hydraulic actuators and the flow rate of hydraulic oil flowing from the hydraulic actuators to a hydraulic oil tank. The hydraulic actuators include the boom cylinder 7, the arm cylinder 8, the bucket cylinder 9, a left traveling hydraulic motor, a right traveling hydraulic motor, and a turning hydraulic motor 2A. FIG. 2 illustrates a control valve 17A for the turning hydraulic motor 2A and a control valve 17B for the arm cylinder 8 as typical examples of the control valves included in the control valve 17.

The operating apparatus 26 is an apparatus that the operator uses to operate hydraulic actuators. According to this embodiment, the operating apparatus 26 can supply hydraulic oil discharged by the pilot pump 15 to the pilot ports of control valves corresponding to the hydraulic actuators through a pilot line. The pressure of hydraulic oil supplied to each pilot port (hereinafter referred to as "pilot pressure") is a pressure commensurate with the direction of operation and the amount of operation of a lever or pedal of the operating apparatus 26 for a corresponding hydraulic actuator. FIG. 2 illustrates a turning operating lever 26A and an arm operating lever 26B as typical examples of the operating apparatus 26.

The remote control valve 27 is a valve that is opened and closed according to the operation of the operating apparatus 26. FIG. 2 illustrates a remote control valve 27A and a remote control valve 27B as typical examples of the remote control valve 27. The hydraulic oil supplied from the pilot pump 15 to the remote control valve 27A is transmitted to a pilot port of the control valve 17A at a flow rate commensurate with the amount of opening of the remote control valve 27A which is opened or closed by the tilting of the turning operating lever 26A. Likewise, the hydraulic oil supplied from the pilot pump 15 to the remote control valve 27B is transmitted to a pilot port of the control valve 17B at a flow rate commensurate with the amount of opening of the remote control valve 27B which is opened or closed by the tilting of the arm operating lever 26B.

The operating pressure sensor 29 is a sensor for detecting the details of the operator's operation using the operating apparatus 26. According to this embodiment, for example, the operating pressure sensor 29 detects the direction of operation and the amount of operation of a lever or pedal of the operating apparatus 26 corresponding to a hydraulic actuator in the form of pressure, and outputs the detected value to the controller 30. FIG. 2 illustrates an operating pressure sensor 29A that detects the details of the operation of the turning operating lever 26A and an operating pressure sensor 29B that detects the details of the operation of the arm operating lever 26B as typical examples of the operating apparatus 26. The details of the operation of the operating apparatus 26 may be detected using a sensor other than a pressure sensor, such as a sensor that detects the tilt of a lever. Furthermore, the turning operating lever 26A and the arm operating lever 26B, which are depicted separately for convenience in FIG. 2, may be configured as a single lever. In this case, a single lever that operates as both the turning operating lever 26A and the arm operating lever 26B is used differently according to a difference in the tilt direction. For example, this single lever may be configured to operate as the arm operating lever 26B when tilted forward or backward and to operate as the turning operating lever 26A when tilted rightward or leftward.

The gate lock lever D1 is configured to switch the enabled state and the disabled state of the operating apparatus 26. The enabled state of the operating apparatus 26 means a state where a corresponding hydraulic actuator operates in response to the operator's operation of the operating apparatus 26. The disabled state of the operating apparatus 26 means a state where a corresponding hydraulic actuator does not operate in response to the operator's operation of the operating apparatus 26.

According to this embodiment, the gate lock lever D1 is installed at the left front end of an operator seat D2. The operator can enable the operating apparatus 26 by pulling up the gate lock lever D1 into an unlocked state D1U (the state indicated by the solid line). In addition, the operator can disable the operating apparatus 26 by depressing the gate lock lever D1 into a locked state D1L (the state indicated by the dotted line).

A gate lock switch S2 is a device that outputs a signal to actuate the gate lock valve 50. According to this embodiment, the gate lock switch S2 is configured to have its state switched by the gate lock lever D1. For example, the gate lock switch S2 is configured to output an UNLOCK signal when the gate lock lever D1 is in the unlocked state D1U, and not to output the UNLOCK signal when the gate lock lever D1 is in the locked state D1L. A LOCK signal may be output when the gate lock lever D1 is in the locked state D1L. The UNLOCK signal and the LOCK signal may be either a current signal or a voltage signal. The controller 30 may output the UNLOCK signal and the LOCK signal.

The gate lock valve 50 is a solenoid valve that switches the opening and closing of a conduit L1 connecting the operating apparatus 26 and the pilot pump 15. According to this embodiment, the gate lock valve 50 may be configured to open the conduit L1 in response to receiving the UNLOCK signal and to close the conduit L1 in response to not receiving the UNLOCK signal. The gate lock valve 50 may be configured to close the conduit L1 in response to receiving the LOCK signal.

The gate lock valve 50 may include multiple solenoid valves. Positions 50A through 50F of FIG. 2 indicate positions at which the gate lock valve 50 may be placed. The gate lock valve 50 may be provided between the pilot pump 15 and each remote control valve 27. For example, the gate lock valve 50 may be provided in an individual conduit for the remote control valve 27A as indicated by the position 50A so that only the turning operating lever 26A can be switched to the disabled state, or may be provided in an individual conduit for the remote control valve 27B as indicated by the position 50B so that only the arm operating lever 26B can be switched to the disabled state. The individual conduits are conduits connecting the conduit L1 and each remote control valve 27. Alternatively, the gate lock valve 50 may be provided between the remote control valve 27 and a control valve. For example, the gate lock valve 50 may be provided between the remote control valve 27A and the control valve 17A as indicated by the positions 50C and 50D so that only the turning operating lever 26A can be switched to the disabled state, or may be provided between the remote control valve 27B and the control valve 17B as indicated by the positions 50E and 50F so that only the arm operating lever 26B can be switched to the disabled state. Thus, the controller 30 may be configured such that the operating apparatuses 26 can be individually switched between the enabled state and the disabled state.

The gate lock relay 51 switches the completion and breakage of an electrical path E1 connecting the gate lock switch S2 and the gate lock valve 50. The gate lock relay 51 is an electromagnetic relay composed of, for example, an armature, a spring, a coil, etc. The gate lock relay 51 may be composed of a semiconductor switching element such as a MOSFET, a transistor, a thyristor or the like.

Figure 3A:
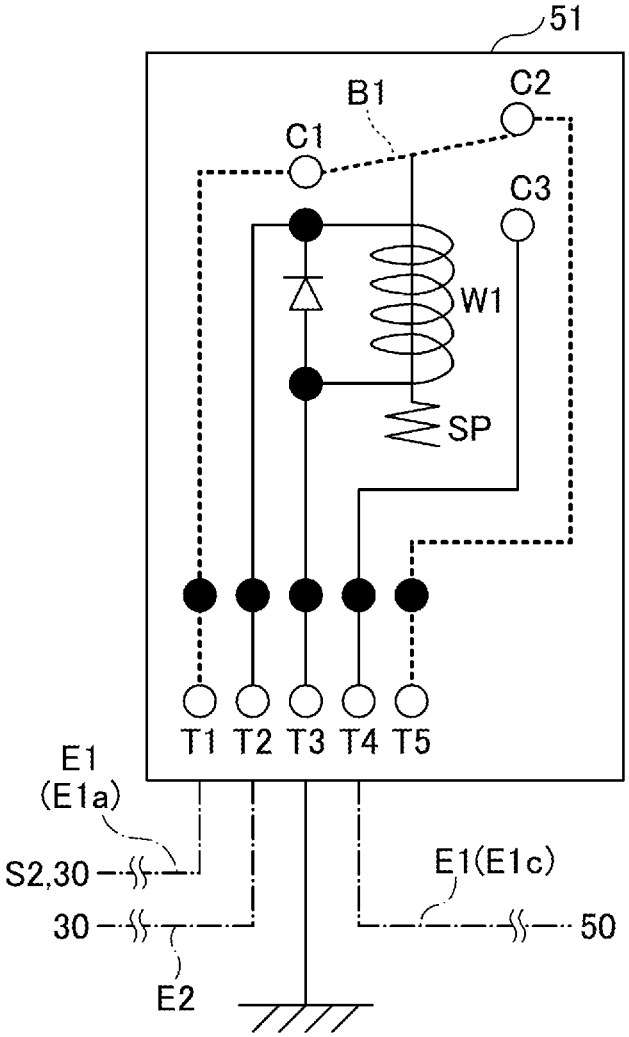
FIG. 3A is an enlarged view of a gate lock relay of FIG. 2.
Figure 3B:
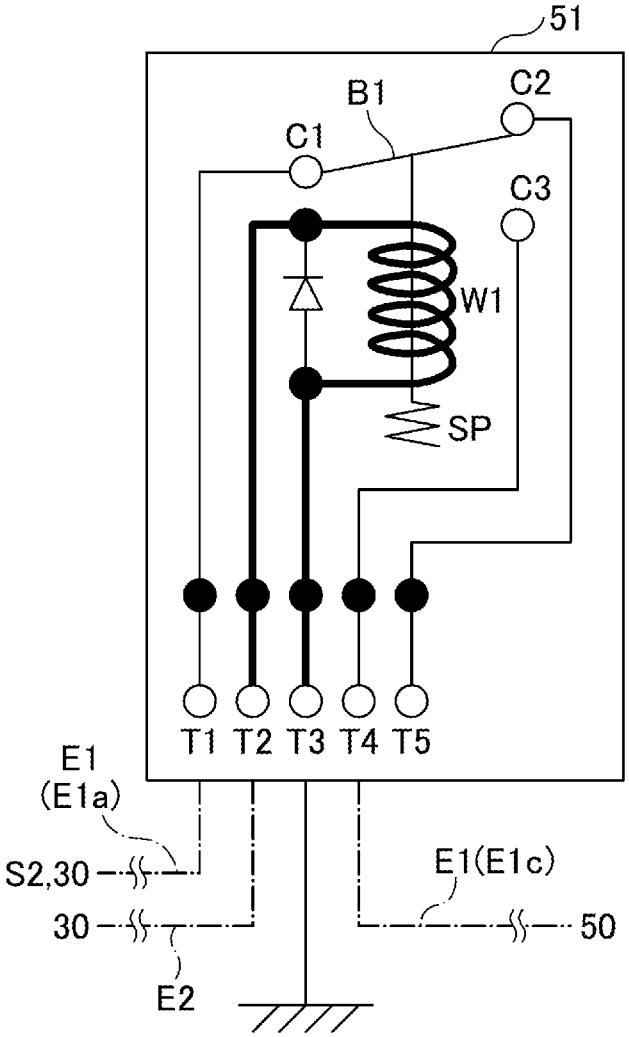
FIG. 3B is an enlarged view of the gate lock relay of FIG. 2.
Figure 3C:
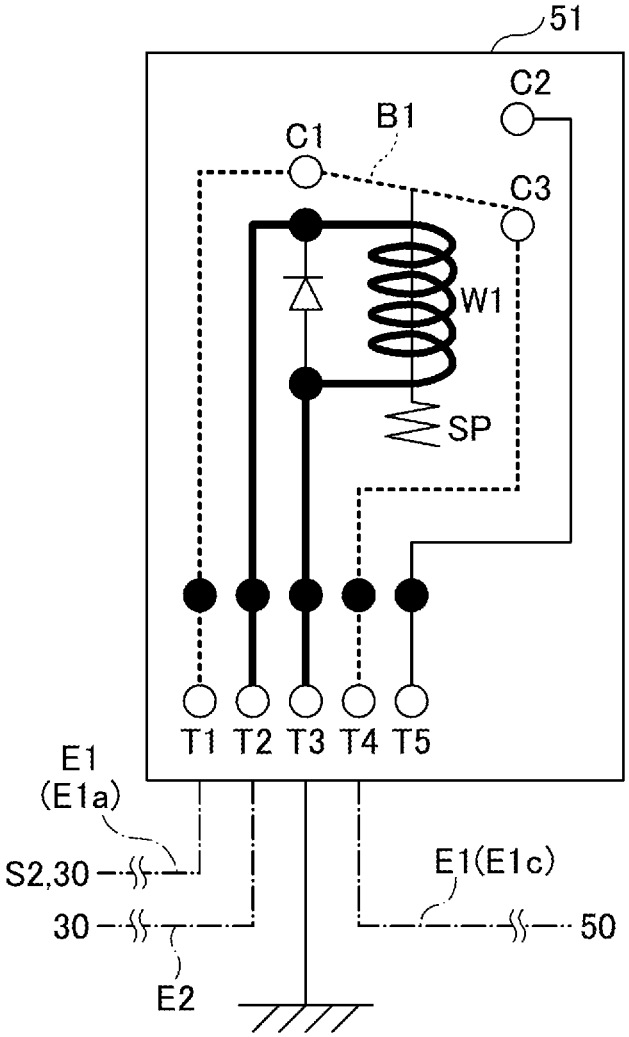
FIG. 3C is an enlarged view of the gate lock relay of FIG. 2.

Here, functions of the gate lock relay 51 are described with reference to FIGS. 3A through 3C. Each of FIGS. 3A through 3C is an enlarged view of the gate lock relay 51 of FIG. 2. Specifically, FIG. 3A illustrates the state (OFF state) of the gate lock relay 51 when the electrical path E1 is broken. FIG. 3B illustrates the state of the gate lock relay 51 when the electrical path E1 transitions from the broken state to the completed state. FIG. 3C illustrates the state (ON state) of the gate lock relay 51 when the electrical path E1 is completed. In FIGS. 3A through 3C, the thick dotted line represents the electrical continuity between associated two terminals and the thick solid line represents electric current flowing through a coil W1.

The gate lock relay 51 includes five terminals T1 through T5. The terminal T1 is connected to the gate lock switch S2 via an electrical path E1*a*. The electrical path E1*a* is also connected to the controller 30 via an electrical path E1*b* as illustrated in FIG. 2. The terminal T2 is connected to the controller 30 via an electrical path E2. The terminal T3 is grounded. The terminal T4 is connected to the gate lock valve 50 via an electrical path E1*c*. The terminal T5 is an open terminal and is not connected anywhere.

As illustrated in FIG. 3A, if no electric current is flowing through the coil W1, an armature B1 connects a contact C1 and a contact C2. Accordingly, as illustrated by the thick dotted line, the terminal T1 and the terminal T5 are in an electrically conductive state. The terminal T5, however, is an open terminal. Therefore, even when a signal is input to the terminal T1, the signal is not transmitted to the gate lock valve 50. In this case, for example, even when the gate lock switch S2 outputs the UNLOCK signal, the gate lock valve 50 does not open the conduit L1 because the gate lock valve 50 cannot receive the UNLOCK signal.

As illustrated in FIG. 3B, when an electric current flows from the controller 30 to the coil W1 via the electrical path E2, the armature B1 is attracted to the coil W1 by the magnetic force generated by the coil W1. As a result, as illustrated in FIG. 3C, the armature B1 connects the contact C1 and a contact C3. As illustrated by the thick dotted line, the terminal T1 and the terminal T4 are in an electrically conductive state. The terminal T4 is connected to the gate lock valve 50 via the electrical path E1*c*. In this state, the gate lock relay 51 can transmit a signal (for example, the UNLOCK signal, the LOCK signal or the like) from the gate lock switch S2 or the controller 30 to the gate lock valve 50.

Here, referring again to FIG. 2, other components of the control system 100 are described. A key switch S3 outputs a signal representing the status of an engine key to the controller 30. For example, the key switch S3 outputs a KEY-ON signal when the engine 11 is in operation, and does not output the KEY-ON signal when the engine 11 is stopped. The key switch S3 may output a KEY-OFF signal when the engine 11 is stopped.

A sheet seating switch S4 outputs a signal representing the seating status of the operator to the controller 30. For example, the sheet seating switch S4 outputs a SEATING signal when the operator is seated in the operator seat D2. The sheet seating switch S4 does not output the SEATING signal when the operator is not seated in the operator seat D2.

A seat belt switch S5 outputs a signal representing the use status of a seat belt to the controller 30. For example, the seat belt switch S5 outputs a SEAT BELT USE signal when the operator seated in the operator seat D2 is wearing the seat belt. The seat belt switch S5 does not output the SEAT BELT USE signal when the operator is not wearing the seat belt.

A cancellation switch S6 cancels the closure of the conduit L1 by the gate lock valve 50. For example, the cancellation switch S6 is a software switch displayed on an in-vehicle display with a touchscreen. The cancellation switch S6 may be a hardware switch installed in the cabin 10, such as a switch provided at the top of the turning operating lever 26A.

When operated by the operator, the cancellation switch S6 outputs a CLOSURE CANCELLATION signal to the controller 30. In response to receiving the CLOSURE CANCELLATION signal, the controller 30 outputs the UNLOCK signal to the gate lock valve 50. In this case, the controller 30 may continue outputting the UNLOCK signal for a predetermined period of time or may prevent the output of the LOCK signal for a predetermined period of time, in order to prevent the conduit L1 from being again closed immediately after the conduit L1 is opened by the gate lock valve 50.

For example, the controller 30 outputs the UNLOCK signal to the gate lock valve 50 when receiving the CLOSURE CANCELLATION signal from the cancellation switch S6 while the gate lock lever D1 is in the unlocked state D1U and the gate lock valve 50 is closed. That is, the controller 30 outputs the UNLOCK signal to the gate lock valve 50 when receiving the CLOSURE CANCELLATION signal from the cancellation switch S6 in the case of not outputting the UNLOCK signal to the gate lock valve 50 or outputting the LOCK signal to the gate lock valve 50. The controller 30, however, does not output the UNLOCK signal to the gate lock valve 50 when receiving the CLOSURE CANCELLATION signal from the cancellation switch S6 while the gate lock lever D1 is in the locked state D1L, in order to prevent the operating apparatus 26 switched to the disabled state by the gate lock lever D1 from being switched to the enabled state. In this case, the controller 30 may output the LOCK signal to the gate lock valve 50.

Next, a determining part 31 and a switching part 32 serving as functional elements of the controller 30 are described.

The determining part 31 determines whether an object is present within a predetermined area around the shovel. For example, the determining part 31 determines whether an object is present within the predetermined area based on the output of the camera S1 serving as an object detector. When the camera 31 includes an image processor, the determining part 31 determines that an object is present within the predetermined area when the camera S1 is outputting a detection signal. When the camera S1 includes no image processor, the determining part 31 determines whether an object is present within the predetermined area by performing various kinds of image processing on an input image captured by the camera S1.

The switching part 32 controls the state of the operating apparatus 26. For example, the switching part 32 controls the state of the operating apparatus 26 when the shovel is in a standby state and the operating apparatus 26 is switched to the enabled state by the gate lock lever D1. The standby state means, for example, that the controller 30 is running, the engine 11 is in operation, and the operating apparatus 26 is not operated (in a neutral state). The state before passage of a predetermined period of time since the stop of the operation of the operating apparatus 26, however, may be excluded. That is, even when the operating apparatus 26 in the neutral state, the standby state may not be determined before passage of a predetermined period of time after the stop of the operation.

For example, the switching part 32 switches the operating apparatus 26 to the disabled state when a predetermined locking condition is satisfied. In this case, even when the gate lock lever D1 is in the unlocked state D1U, the operating apparatus 26 is switched to the disabled state. The switching part 32 switches the operating apparatus 26 to the enabled state when a predetermined unlocking condition is satisfied after switching the operating apparatus 26 to the disabled state. The switching part 32, however, does not switch the operating apparatus 26 to the enabled state when the gate lock lever D1 is in the locked state D1L.

Examples of locking conditions include a determination by the determining part 31 that an object is present within the predetermined area, and may further include the interruption of the SEATING signal output by the seat seating switch S4, the interruption of the SEAT BELT USE signal output by the seat belt switch 35, the continuation of the standby state of the shovel for a predetermined period of time, etc. The switching part 32 may switch the operating apparatus 26 to the disabled state when at least one of these locking conditions is satisfied, or may switch the operating apparatus 26 to the disabled state when each locking condition in a predetermined combination of these locking conditions is satisfied.

Examples of unlocking conditions include the operation of the cancellation switch S6, a determination by the determining part 31 that an object has exited the predetermined area, the restart of the output of the SEATING signal by the seat seating switch S4, the restart of the output of the SEAT BELT USE signal by the seat belt switch S5, the operation of the gate lock lever D1 from the locked state D1L to the unlocked state D1U, etc. The switching part 32 may switch the operating apparatus 26 to the enabled state when at least one of these unlocking conditions is satisfied, or may switch the operating apparatus 26 to the enabled state when each unlocking condition in a predetermined combination of these unlocking conditions is satisfied.

Figure 4:
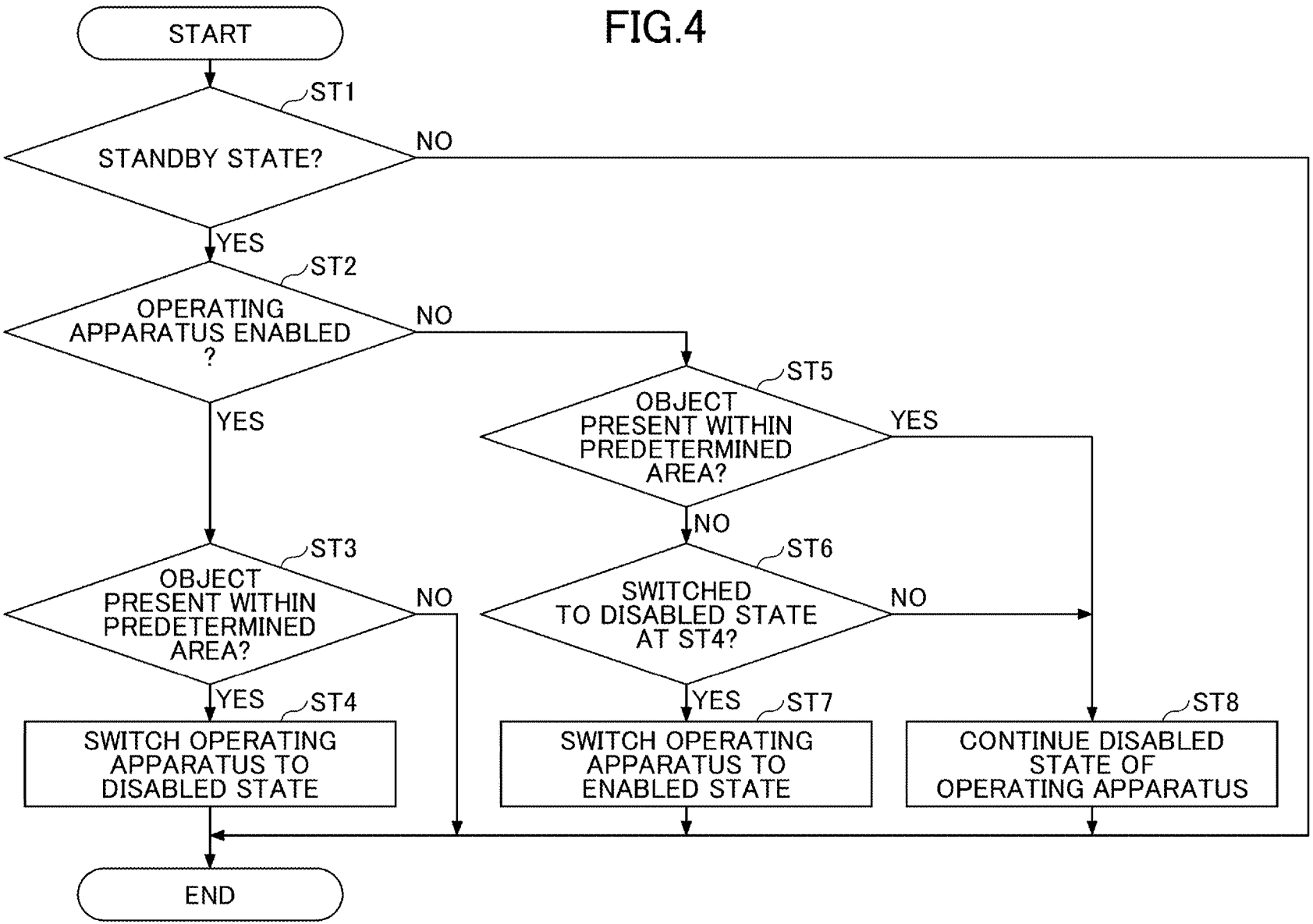
FIG. 4 is a flowchart of an example of a switching process.

Next, a process of switching the state of the operating apparatus 26 by the controller 30 (hereinafter referred to as "switching process") is described with reference to FIG. 4. FIG. 4 is a flowchart of an example of the switching process. The controller 30 repeatedly executes this switching process at predetermined control intervals.

First, the switching part 32 of the controller 30 determines whether the shovel is in the standby state (step ST1). According to this embodiment, the switching part 32 determines whether the shovel is in the standby state based on the output of the key switch S3 and the output of the operating pressure sensor 29.

In response to determining that the shovel is not in the standby state (NO at step ST1), the switching part 32 ends the switching process of this time.

In response to determining that the shovel is in the standby state (YES at step ST1), the switching part 32 determines whether the operating apparatus 26 is enabled (step ST2). According to this embodiment, the switching part 32 determines whether the operating apparatus 26 is enabled based on the output of the gate lock switch S2 and the state of the gate lock relay 51. Furthermore, the switching part 32 determines that the operating apparatus 26 is enabled when the switching part 32 is outputting the UNLOCK signal. Furthermore, the switching part 32 determines that the gate lock relay 51 is turned ON when supplying electric current to the coil W1 of the gate lock relay 51 (see FIG. 3C). The switching part 32 determines that the gate lock relay 51 is turned OFF when supplying no electric current to the coil W1 (see FIG. 3A).

Specifically, the switching part 32 determines that the operating apparatus 26 is enabled when the gate lock relay 51 is turned ON and the gate lock switch S2 or the switching part 32 is outputting the UNLOCK signal. When the gate lock relay 51 is turned OFF, the switching part 32 determines that the operating apparatus 26 is disabled. The switching part 32 determines that the operating apparatus 26 is disabled when the gate lock relay 51 is turned ON and neither the gate lock switch S2 nor the switching part 32 is outputting the UNLOCK signal. The switching part 32 may determine that the operating apparatus 26 is disabled when the gate lock relay 51 is turned ON and the gate lock switch S2 or the switching part 32 is outputting the LOCk signal.

If the switching part 32 determines that the operating apparatus 26 is enabled (YES at step ST2), the determining part 31 of the controller 30 determines whether an object is present within the predetermined area (step ST3). At this point, if the determining part 31 determines the absence of an object (NO at step ST3), the controller 30 ends the switching process of this time.

If the determining part 31 determines the presence of an object (YES at step ST3), the switching part 32 switches the operating apparatus 26 to the disabled state (step ST4). According to this embodiment, the switching part 32 switches the operating apparatus 26 to the disabled state by turning OFF the gate lock relay 51 as illustrated in FIG. 3A, namely, by preventing the UNLOCK signal from being transmitted to the gate lock valve 50. Then, the controller 30 repeatedly executes the above-described switching process at predetermined control intervals.

The switching part 32 may switch the operating apparatus 26 to the disabled state by reducing a pilot pressure generated by the operating apparatus 26 using a proportional valve or the like. Alternatively, the switching part 32 may switch the operating apparatus 26 to the disabled state by locking the motion of the operating apparatus 26 by actuating a lever lock device attached as an accessory. Alternatively, the switching part 32 may switch the operating apparatus 26 to the disabled state by reducing the relief pressure of the main pump 14. That is, the switching part 32 may switch the operating apparatus 26 to the disabled state by releasing hydraulic oil discharged by the main pump 14 to the hydraulic oil tank to reduce its discharge pressure to such a level as to be unable to move a hydraulic actuator.

If the switching part 32 determines at step ST2 that the operating apparatus 26 is disabled (NO at step ST2), the determining part 31 determines whether an object is present within the predetermined area (step ST5). This determination includes, for example, a determination as to whether an object determined to be present within the predetermined area has exited the predetermined area. For example, after determining at step ST3 that an object is present within the predetermined area and switching the operating apparatus 26 to the disabled state, the controller 30 executes the determination of step ST5. At this point, if the determining part 31 determines that an object is present within the predetermined area (YES at step ST5), the controller 30 continues the disabled state of the operating apparatus 26 (step ST8), and ends the switching process of this time. For example, if the determining part 31 determines that the object has not exited the predetermined area (the object is still present within the predetermined area) (YES at step ST5), the controller 30 continues the disabled state of the operating apparatus 26 (step ST8), and ends the switching process of this time.

If the determining part 31 determines that no object is present within the predetermined area (NO at step ST5), the switching part 32 determines whether the operating apparatus 26 has been switched to the disabled state at step ST4 (step ST6). For example, if the determining part 31 determines that the object has exited the predetermined area (the object is no longer present within the predetermined area) (NO at step ST5), the switching part 32 determines whether the current disabled state of the operating apparatus 26 is due to the switching at step ST4. Instead of determining whether the current disabled state of the operating apparatus 26 is due to the switching at step ST4, however, the switching part 32 may determine whether the gate lock lever D1 is in the unlocked state D1U.

In response to determining that the operating apparatus 26 has not been switched to the disabled state at step ST4, namely, that the current disabled state of the operating apparatus 26 is not due to the switching at step ST4 (NO at step ST6), the controller 30 continues the disabled state of the operating apparatus 26 (step ST8), and ends the switching process of this time. For example, in response to determining that the current disabled state of the operating apparatus 26 is due to the locked state D1L of the gate lock lever D1, the controller 30 ends the switching process of this time without switching the operating apparatus 26 to the enabled state. Thus, when the operating apparatus 26 is switched to the disabled state by the gate lock lever D1 during the standby state of the shovel, the controller 30 continues the disabled state of the operating apparatus 26 irrespective of the presence or absence of an object within the predetermined area.

In response to determining that the operating apparatus 26 has been switched to the disabled state at step ST4, namely, that the current disabled state of the operating apparatus 26 is due to the switching at step ST4 (YES at step ST6), the controller 30 switches the operating apparatus 26 to the enabled state (step ST7). According to this embodiment, the controller 30 turns ON the gate lock relay 51 as illustrated in FIG. 3C to allow the UNLOCK signal to be transmitted to the gate lock valve 50. In this case, the gate lock lever D1 is in the unlocked state D1U, and the gate lock switch S2 is outputting the UNLOCK signal. Therefore, the UNLOCK signal is transmitted to the gate lock valve 50 via the electrical paths E1*a* and E1*c*. As a result, in response to receiving the UNLOCK signal, the gate lock valve 50 opens the conduit L1 to switch the operating apparatus 26 to the enabled state. If the gate lock switch S2 is not outputting the UNLOCK signal despite the unlocked state D1U of the gate lock lever D1, the switching part 32 may switch the operating apparatus 26 to the enabled state by outputting the UNLOCK signal in place of the gate lock switch S2.

The switching part 32 may return the operating apparatus 26 to the enabled state if the determining part 31 determines that the object has exited the predetermined area and that the operating apparatus 26 is in the neutral state, in order to prevent the operating apparatus 26 from being enabled when the operating apparatus 26 is not in the neutral state.

Furthermore, even when the determining part 31 determines that the object has exited the predetermined area, the switching part 32 may keep the operating apparatus 26 disabled before the operating apparatus 26 is further switched to the enabled state after being switched to the disabled state by the gate lock lever D1. That is, the switching part 32 may prevent the operating apparatus 26 from returning to the enabled state before the operator further switches the gate lock lever D1 to the unlocked state D1U after the operator switches the gate lock lever D1 to the locked state D1L, in order to confirm the operator's intention to return the operating apparatus 26 to the enabled state. For example, when a worker as an object climbs up the upper turning body 3 or goes underneath the lower traveling body 1, the determining part 31 may determine that the object has exited the predetermined area depending on the location of the object detector. Therefore, for example, the switching part 32 may prevent the operating apparatus 26 from returning to the enabled state during a period before the intention of the operator can be confirmed, such as a period before the operator further switches the gate lock lever D1 to the unlocked state D1U after the operator switches the gate lock lever D1 to the locked state D1L.

Even after switching the operating apparatus 26 to the disabled state, the controller 30 may return the operating apparatus 26 to the enabled state when the operator depresses the cancellation switch S6. For example, the controller 30 may return the operating apparatus 26 to the enabled state even when it is determined that an object is present within the predetermined area.

According to the above-described configuration, the controller 30 can disable the operating apparatus 26 in response to determining the presence of an object within the predetermined area even when the gate lock lever D1 is in the unlocked state D1U. Furthermore, the controller 30 can return the operating apparatus 26 to the enabled state in response to determining that the object has exited the predetermined area after switching the operating apparatus 26 to the disabled state.

Therefore, it is possible to prevent a hydraulic actuator from moving because of an inappropriate movement of the operating apparatus 26 during suspension of the operation of the shovel with the operating apparatus 26 being still enabled. For example, in the case where it is determined that an object is present within the predetermined area when the gate lock lever D1 is in the unlocked state D1U, the operating apparatus 26 can be disabled irrespective of the operation of the gate lock lever D1. Therefore, it is possible to prevent the operator from operating the operating apparatus 26 and moving a hydraulic actuator without noticing the object.

Figure 5:
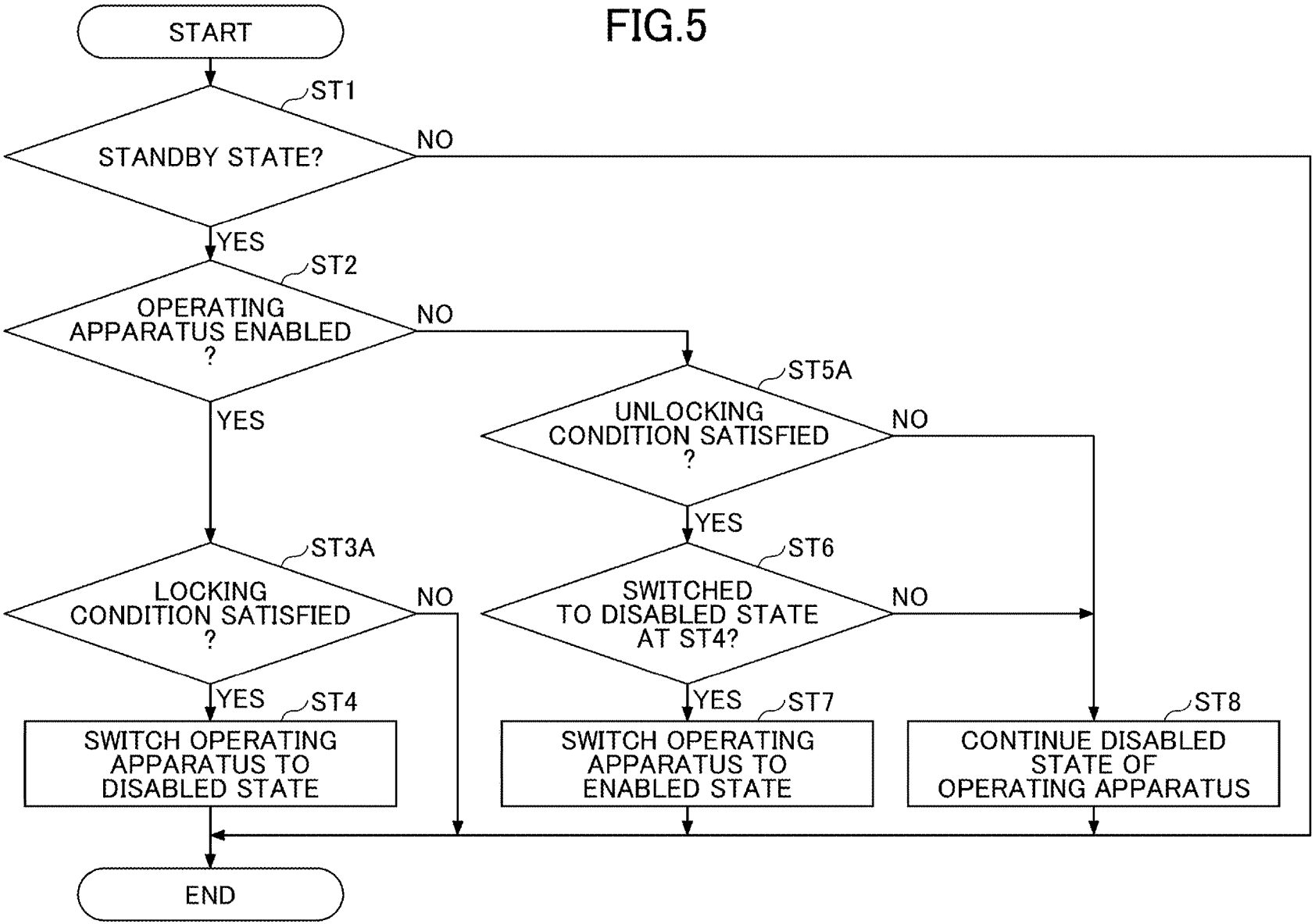
FIG. 5 is a flowchart of another example of the switching process.

Next, another example of the switching process is described with reference to FIG. 5. FIG. 5 is a flowchart of another example of the switching process. The controller 30 repeatedly executes this process at predetermined control intervals. The flowchart of FIG. 5 is different in the details of step ST3A and step ST5A from, but equal in the other steps to, the flowchart of FIG. 4. Therefore, a description of the common portion is omitted, and differences are described in detail.

In response to determining that the operating apparatus 26 is enabled (YES at step ST2), the switching part 32 determines whether the locking condition is satisfied (step ST3A). At this point, in response to determining that the locking condition is not satisfied (NO at step ST3A), the switching part 32 ends the switching process of this time.

In response to determining that the locking condition is satisfied (YES at step ST3A), the switching part 32 switches the operating apparatus 26 to the disabled state (step ST4). For example, the switching part 32 controls the gate lock relay 51 based on the output of at least one of the gate lock switch S2, the key switch S3, the seat seating switch S4, and the seat belt switch S5. In this case, the determination result of the determining part 31, the duration of the standby state, etc., may also be taken into consideration. Specifically, when the seat seating switch S4 is not outputting the SEATING signal while the gate lock switch S2 is outputting the UNLOCK signal and the key switch S3 is outputting the KEY-ON signal, the switching part 32 switches the operating apparatus 26 to the disabled state by turning OFF the gate lock relay 51. Alternatively, when the seat belt switch S5 is not outputting the SEAT BELT USE signal while the gate lock switch S2 is outputting the UNLOCK signal and the key switch S3 is outputting the KEY-ON signal, the switching part 32 switches the operating apparatus 26 to the disabled state by turning OFF the gate lock relay 51.

In response to determining at step ST2 that the operating apparatus 26 is disabled (NO at step ST2), the switching part 32 determines whether the unlocking condition is satisfied (step ST5A). At this point, in response to determining that the unlocking condition is not satisfied (NO at step ST5A), the switching part 32 continues the disabled state of the operating apparatus 26 (step ST8), and ends the switching process of this time.

In response to determining that the unlocking condition is satisfied (YES at step ST5A), the switching part 32 determines whether the operating apparatus 26 has been switched to the disabled state at step ST4 (step ST6). For example, the switching part 32 determines whether the current disabled state of the operating apparatus 26 is due to the switching at step ST4. Instead of determining whether the current disabled state of the operating apparatus 26 is due to the switching at step ST4, however, the switching part 32 may determine whether the gate lock lever D1 is in the unlocked state D1U.

In response to determining that the operating apparatus 26 has not been switched to the disabled state at step ST4, namely, that the current disabled state of the operating apparatus 26 is not due to the switching at step ST4 (NO at step ST6), the controller 30 continues the disabled state of the operating apparatus 26 (step ST8), and ends the switching process of this time. For example, in response to determining that the current disabled state of the operating apparatus 26 is due to the locked state D1L of the gate lock lever D1, the controller 30 ends the switching process of this time without switching the operating apparatus 26 to the enabled state. Thus, when the operating apparatus 26 is switched to the disabled state by the gate lock lever D1 during the standby state of the shovel, the controller 30 continues the disabled state of the operating apparatus 26 irrespective of whether the unlocking condition is satisfied.

In response to determining that the operating apparatus 26 has been switched to the disabled state at step ST4, namely, that the current disabled state of the operating apparatus 26 is due to the switching at step ST4 (YES at step ST6), the controller 30 switches the operating apparatus 26 to the enabled state (step ST7). For example, the switching part 32 controls the gate lock relay 51 based on the determination result of the determining part 31 and the output of at least one of the gate lock switch S2, the key switch S3, the seat seating switch S4, and the seat belt switch S5. In this case, the duration of the disabled state may be taken into consideration. Specifically, when the gate lock switch S2 is outputting the UNLOCK signal, the key switch S3 is outputting the KEY-ON signal, the seat seating switch S4 is outputting the SEATING signal, and the seat belt switch S5 is outputting the SEAT BELT USE signal while it is determined that no object is present within the predetermined area, the switching part 32 switches the operating apparatus 26 to the enabled state by turning ON the gate lock relay 51.

According to this configuration, the controller 30 can disable the operating apparatus 26 if the locking condition is satisfied even when the gate lock lever D1 is in the unlocked state D1U. Furthermore, even after switching the operating apparatus 26 to the disabled state, the controller 30 can return the operating apparatus 26 to the enabled state if the unlocking condition is satisfied.

Therefore, it is possible to prevent a hydraulic actuator from moving because of an inadvertent or inappropriate movement of the operating apparatus 26 during suspension of the operation of the shovel with the operating apparatus 26 being still enabled. For example, when the standby state of the shovel continues for a predetermined period of time while the gate lock lever D1 is in the unlocked state D1U, the operating apparatus 26 can be disabled irrespective of the operation of the gate lock lever D1. Therefore, it is possible to prevent a hydraulic actuator from moving even when the operating apparatus 26 is thereafter accidentally moved. The same applies to the case where the seat belt is unfastened while the gate lock lever D1 is in the unlocked state D1U and the case where the operator rises from the seat while the gate lock lever D1 is in the unlocked state D1U.

Even after switching the operating apparatus 26 to the disabled state, the controller 30 can return the operating apparatus 26 to the enabled state when the cancellation switch S6 is depressed. For example, the controller 30 can return the operating apparatus 26 to the enabled state even when other unlocking conditions are not satisfied.

Figure 6A:
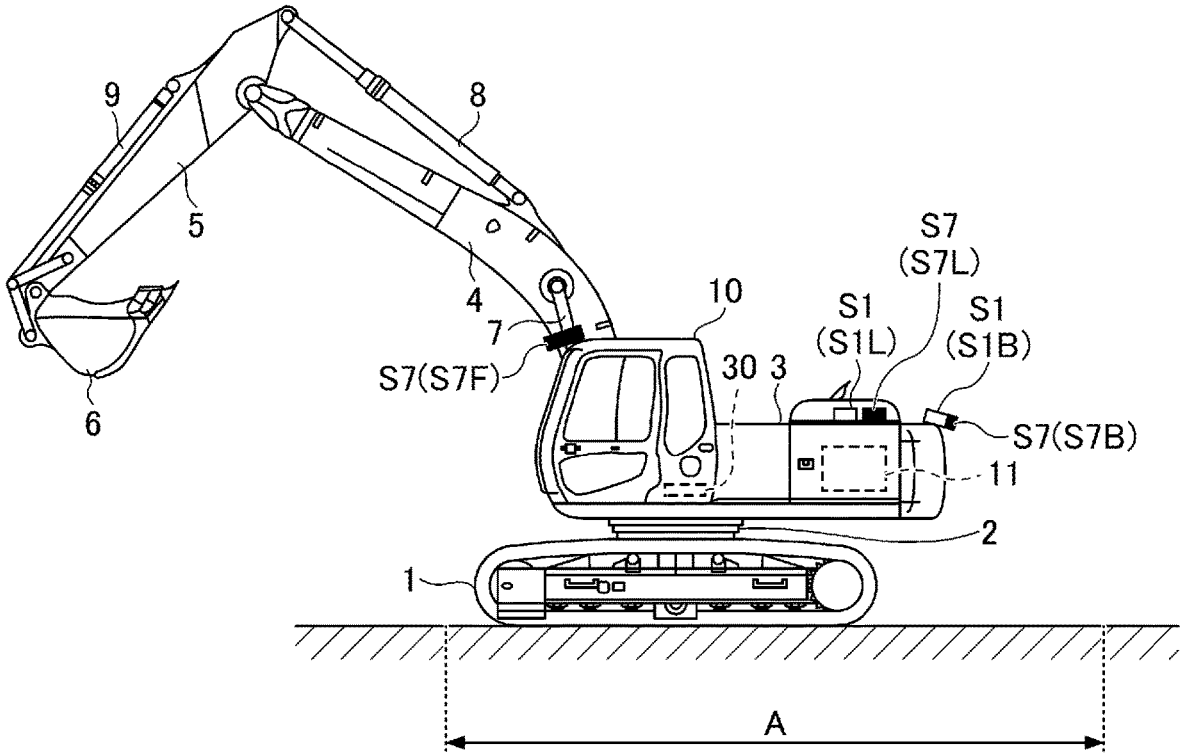
FIG. 6A is a side view of a shovel according to another embodiment of the present invention.
Figure 6B:
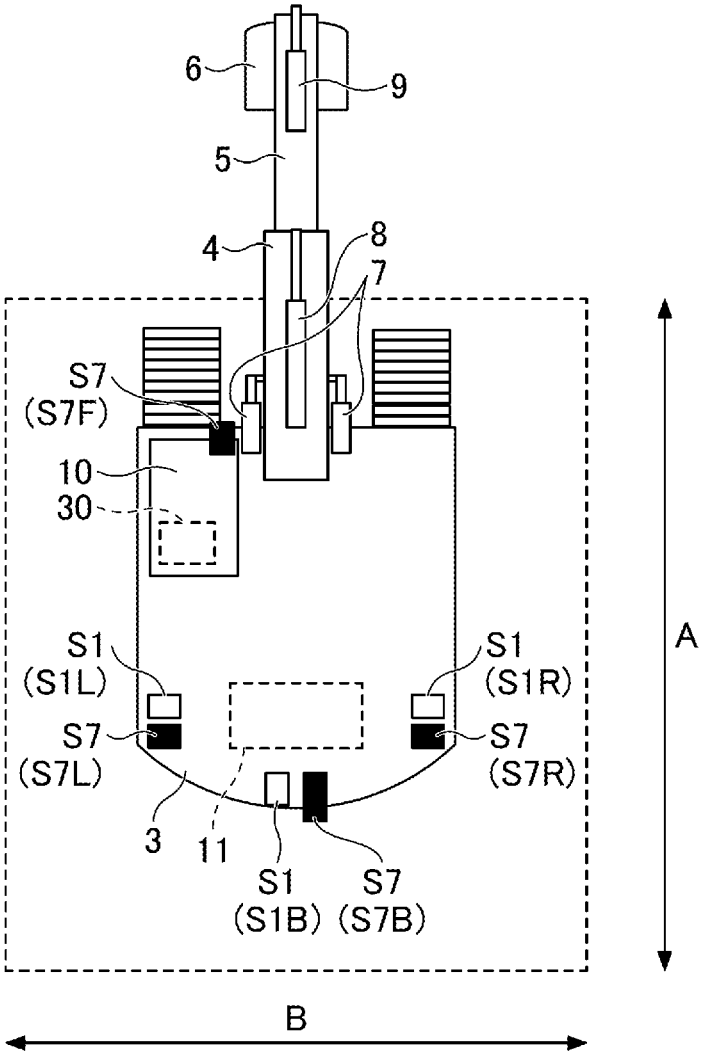
FIG. 6B is a plan view of the shovel according to the other embodiment of the present invention.

Next, a shovel according to another embodiment of the present invention is described with reference to FIGS. 6A and 6B. FIG. 6A is a side view of the shovel and corresponds to FIG. 1A. FIG. 6B is a plan view of the shovel and corresponds to FIG. 1B.

The shovel illustrated in FIGS. 6A and 6B is different in that an object detector S7 is installed separately from the camera S1, but otherwise equal to, the shovel illustrated in FIGS. 1A and 1B. Therefore, a description of the common portion is omitted, and differences are described in detail.

The object detector S7 is configured to detect an object within a predetermined area around the shovel. Examples of the object detector S7 include a LIDAR, an ultrasonic sensor, a millimeter wave sensor, a laser radar sensor, an infrared sensor, and a stereo camera. According to this example, the object detector S7 includes a front sensor S7F attached to the front end of the upper surface of the upper turning body 3, a back sensor S7B attached to the back end of the upper surface of the upper turning body 3, a left sensor S7L attached to the left end of the upper surface of the upper turning body 3, and a right sensor S7R attached to the right end of the upper surface of the upper turning body 3.

The back sensor S7B is placed adjacent to the back camera S1B. The left sensor S7L is placed adjacent to the left camera S1L. The right sensor S7R is placed adjacent to the right camera S1R.

The object detector S7 may include an object detector that monitors an area over the upper turning body 3, in order to detect a worker who works on top of the upper turning body 3, etc. Furthermore, the object detector S7 may include an object detector that monitors an area below the lower traveling body 1, in order to detect a worker who goes and works underneath the lower traveling body 1.

According to this configuration, the shovel can more accurately determine the presence or absence of an object within a predetermined area around the shovel.

Embodiments of the present invention are described in detail above. The present invention, however, is not limited to the above-described embodiments, and various variations, replacements, etc., may be applied to the above-described embodiments without departing from the scope of the present invention.

For example, according to the above-described embodiments, a hydraulic operating lever with a hydraulic pilot circuit is disclosed. Specifically, according to a hydraulic pilot circuit for the turning operating lever 26A, the hydraulic oil supplied from the pilot pump 15 to the remote control valve 27A is transmitted to a pilot port of the control valve 17A at a flow rate commensurate with the amount of opening of the remote control valve 27A that is opened or closed by the tilting of the turning operating lever 26A. According to a hydraulic pilot circuit for the arm operating lever 26B, the hydraulic oil supplied from the pilot pump 15 to the remote control valve 27B is transmitted to a pilot port of the control valve 17B at a flow rate commensurate with the amount of opening of the remote control valve 27B that is opened or closed by the tilting of the arm operating lever 26B.

Instead of such a hydraulic operating lever with a hydraulic pilot circuit, however, an electrical operating lever with an electrical pilot circuit may be employed. In this case, the amount of lever operation of the electrical operating lever is input to the controller 30 as an electrical signal. Furthermore, a solenoid valve is disposed between the pilot pump 15 and a pilot port of each control valve. The solenoid valve is configured to operate in response to an electrical signal from the controller 30. According to this configuration, when a manual operation using the electrical operating lever is performed, the controller 30 can move each control valve by increasing or decreasing a pilot pressure by controlling the solenoid valve with an electrical signal corresponding to the amount of lever operation. Each control valve may be composed of a solenoid spool valve. In this case, the solenoid spool valve operates in response to an electrical signal from the controller 30 commensurate with the amount of lever operation of the electrical operating lever.

Furthermore, according to the above-described embodiments, the object detector detects an object. Here, the image of the detected object may be displayed on a display device 40. Furthermore, the display device 40 may individually display the respective captured images of the cameras S1 provided on the upper turning body 3 and may display an overhead view image into which multiple images are combined. Furthermore, the display device 40 may display the position of the object detected by the object detector on a display screen on which the shovel is graphically displayed. For example, the display device 40 may graphically display the shovel and multiple separate regions along the periphery of the graphic shovel, and highlight a graphic region representing a region including the position of the object detected by the object detector. Thus, the display device 40 performs display based on the positional relationship between the upper turning body 3 and the object detected by the object detector in such a manner as to show the relationship with the position of the object detected by the object detector in an area along the periphery of the graphic showing the upper turning body 3. Furthermore, for example, the display device 40 may display a first graphic region representing a first region closer to the shovel and a second graphic region representing a second region more distant from the shovel than the first region along the periphery of the graphic shovel. At this point, the method of highlighting may be changed depending on the distance, such that the first graphic region is highlighted in red and the second graphic region is highlighted in yellow. As a result, the operator can determine in which part around the shovel the object has been detected. Furthermore, when the object detector detects an object, the display device 40 may switch a currently displayed image to an image captured by a camera imaging the detected object. For example, when an object is detected in a space on the right side of the shovel during the display of a back side image captured by the back camera S1B, the display device 40 may switch to an image showing the right side space of the shovel (for example, an overhead view image or a right side image captured by the right camera S1R) or display the right side image in addition to the back side image.

Furthermore, the shovel may be configured to include multiple loudspeakers around the operator seat D2 and, based on the positional relationship between the upper turning body 3 and an object detected by the object detector, emit an alarming sound from a loudspeaker corresponding to the positional relationship. For example, the shovel may be configured to include three loudspeakers one on each of the right side, left side, and back side of the operator seat D2 and emit a sound from the back side loudspeaker in response to detecting an object behind the upper turning body 3.

What is claimed is:

1. A shovel comprising:

a lower traveling body;

an upper traveling body turnably mounted on the lower traveling body;

a hydraulic actuator;

an object detector configured to detect an object within a predetermined area around the shovel; and a hardware processor configured to determine whether the object detector has detected the object, during a standby state of the shovel, the standby state including a state in which a power source is in operation and an operating apparatus configured to operate the hydraulic actuator is in a neutral state.

2. The shovel as claimed in claim 1, further comprising:

the operating apparatus, wherein the hardware processor is configured to disable the operating apparatus in response to determining that the object detector has detected the object.

3. The shovel as claimed in claim 2, wherein the hardware processor is configured to return the operating apparatus to an enabled state in response to determining that a predetermined condition is satisfied after disabling the operating apparatus.

4. The shovel as claimed in claim 3, further comprising:

a switch configured to return the operating apparatus disabled by the hardware processor to the enabled state.

5. The shovel as claimed in claim 4, wherein the switch is displayed on a display.

6. The shovel as claimed in claim 2, wherein the hardware processor is configured to switch the operating apparatus from a disabled state to an enabled state after confirming an operator's intention to return the operating apparatus to the enabled state.

7. The shovel as claimed in claim 2, further comprising:

a relay configured to be prevented from outputting a signal to switch the operating apparatus to an enabled state in response to receiving a signal corresponding to an operation of a gate lock lever to enable the operating apparatus, unless a predetermined condition is satisfied.

* * * * *